US007273397B2

(12) United States Patent
Watanabe et al.

(10) Patent No.: US 7,273,397 B2
(45) Date of Patent: Sep. 25, 2007

(54) ELECTRICAL CONNECTOR HAVING FLEXIBLE MATING PORTION

(75) Inventors: Tsuneki Watanabe, Yokohama (JP); Gwou-Jong Tseng, Tu-Cheng (TW); Meng-Huan Yang, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/645,392

(22) Filed: Dec. 26, 2006

(65) Prior Publication Data

US 2007/0149054 A1 Jun. 28, 2007

(30) Foreign Application Priority Data

Dec. 26, 2005 (TW) ..... 94222620 U

(51) Int. Cl.
*H01R 13/648* (2006.01)

(52) U.S. Cl. ..... 439/607

(58) Field of Classification Search ..... 439/607, 439/350–357, 953
See application file for complete search history.

(56) References Cited

U.S. PATENT DOCUMENTS 5,197,901 A * 3/1993 Hashiguchi ..... 439/352
5,425,657 A * 6/1995 Davis et al. ..... 439/610
6,039,606 A * 3/2000 Chiou ..... 439/610
6,231,393 B1 * 5/2001 Lai ..... 439/610
6,280,252 B1 * 8/2001 Huang ..... 439/610
6,358,088 B1 3/2002 Nishio et al.
6,540,542 B1 * 4/2003 Simmel ..... 439/352
6,902,432 B2 * 6/2005 Morikawa et al. ..... 439/607
7,033,218 B2 * 4/2006 Huang et al. ..... 439/607
7,052,322 B2 * 5/2006 Hu et al. ..... 439/607
7,083,459 B1 * 8/2006 Wu et al. ..... 439/354

* cited by examiner

*Primary Examiner*—Ross Gushi
*Assistant Examiner*—Larisa Tsukerman
(74) *Attorney, Agent, or Firm*—Wei Te Chung

(57) ABSTRACT

An electrical connector (100) adapted for connecting/disconnecting with/from a complementary connector in a front-to-back direction, includes a shell (1), an insulative housing (2) and a number of contacts (4) received in the housing. The shell includes a main body (111), a connecting tab (115) and a mating portion (112). The main body further includes a receiving space surrounded by a top surface (113), a bottom surface (117), and a pair of lateral surfaces (114). The connecting tab only connects with one edge of said surface of the main body. The mating portion extends from the connecting tab in the front-to-back direction. The insulative housing includes a base portion (21) received in the receiving space of the main body of the shell, and a tongue portion (22) extending from the base portion along the mating direction and received in the mating portion of the shell.

12 Claims, 7 Drawing Sheets

ELECTRICAL CONNECTOR HAVING FLEXIBLE MATING PORTION

CROSS-REFERENCE

This is related to U.S. patent application Ser. No. 10/401,082, filed on Apr. 10, 2006 and entitled "ELECTRICAL CONNECTOR ASSEMBLY WITH MULTI-FUNCTION LATCHING MEMBER", now U.S. Pat. No. 7,134,900, which have the same applicant and assignee as the present invention.

BACKGROUND OF THE INVENTION

1. Field of the Invention

The present invention relates to an electrical connector, and particularly to a micro electrical connector for mating with a complementary connector.

2. Description of Prior Arts

A force is certainly needed during an electrical connector connecting or disconnecting with a complementary connector. Normally, this force has little effect on normal size connector, because the normal size connector always has a firm structure. However, a micro connector always has a very weak structure, so it is easily broken when the force is overage. The complementary connector is always arranged in the electronic equipment. If the complementary connector is broken, it is difficult to be replaced and repaired.

Obviously, it is desirable to have an improved electrical connector to avoid damage to the complementary connector.

SUMMARY OF THE INVENTION

An object of the present invention is to provide an electrical connector to avoid damage to a complementary connector.

To achieve the above object, an electrical connector adapted for connecting/disconnecting with/from a complementary connector in a front-to-back direction, includes a shell, an insulative housing and a number of contacts received in the housing. The shell includes a main body, a connecting tab and a mating portion, the main body further includes a receiving space surrounded by a top surface, a bottom surface, and a pair of lateral surfaces. The connecting tab only connects with one edge of said surfaces of the main body. The mating portion extends from the connecting tab in the front-to-back direction. The insulative housing includes a base portion receiving in the receiving space of the main body of the shell and a tongue portion extending from the base portion along the mating direction received in the mating portion of the shell.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
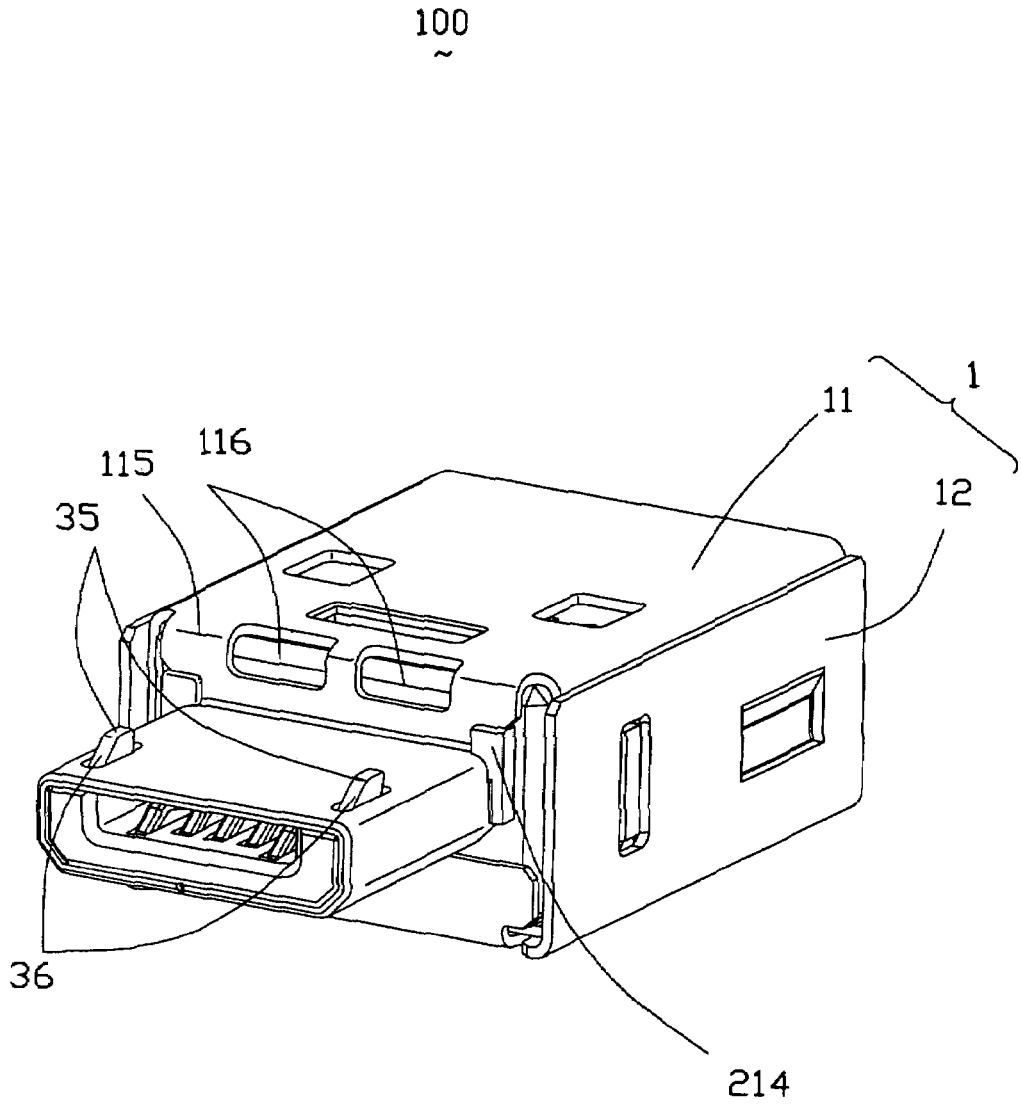
FIG. 1 is an assembled, perspective view of an electrical connector in accordance with the present invention.

Referring to FIGS. 1 to 4, an electrical connector 100 in accordance with the present invention comprises a metal shell 1, an insulative housing 2, a plurality of contacts 4 received in the insulative housing 2, a pair of locking member 3, and a stopping block 5. In the present embodiment, the electrical connector 100 is in accordance with a micro USB standard. However, in alternative embodiment, the electrical connector could be provided as other types.

Figure 2:
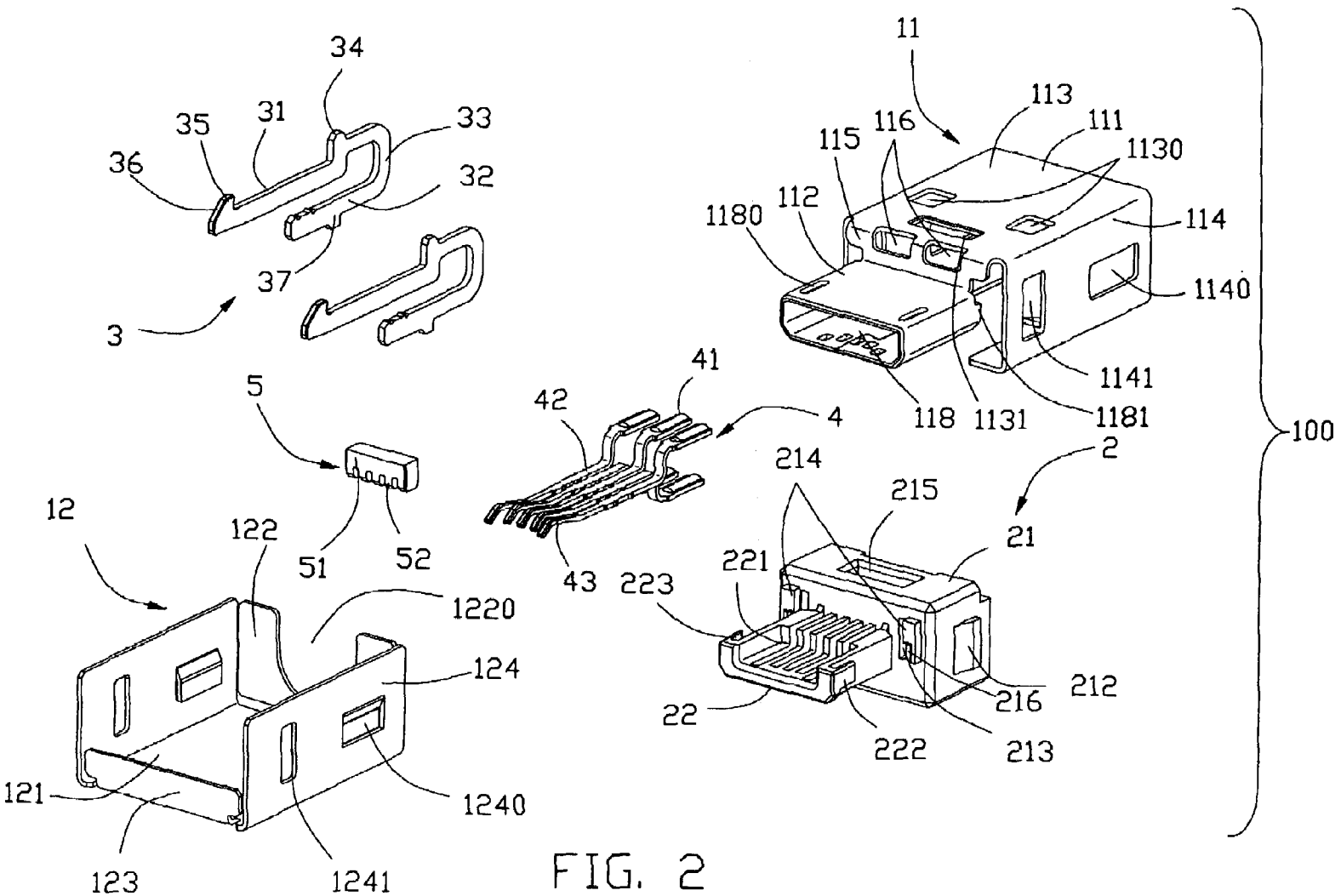
FIG. 2 is an exploded, perspective view of the electrical connector shown in FIG. 1.
Figure 3:
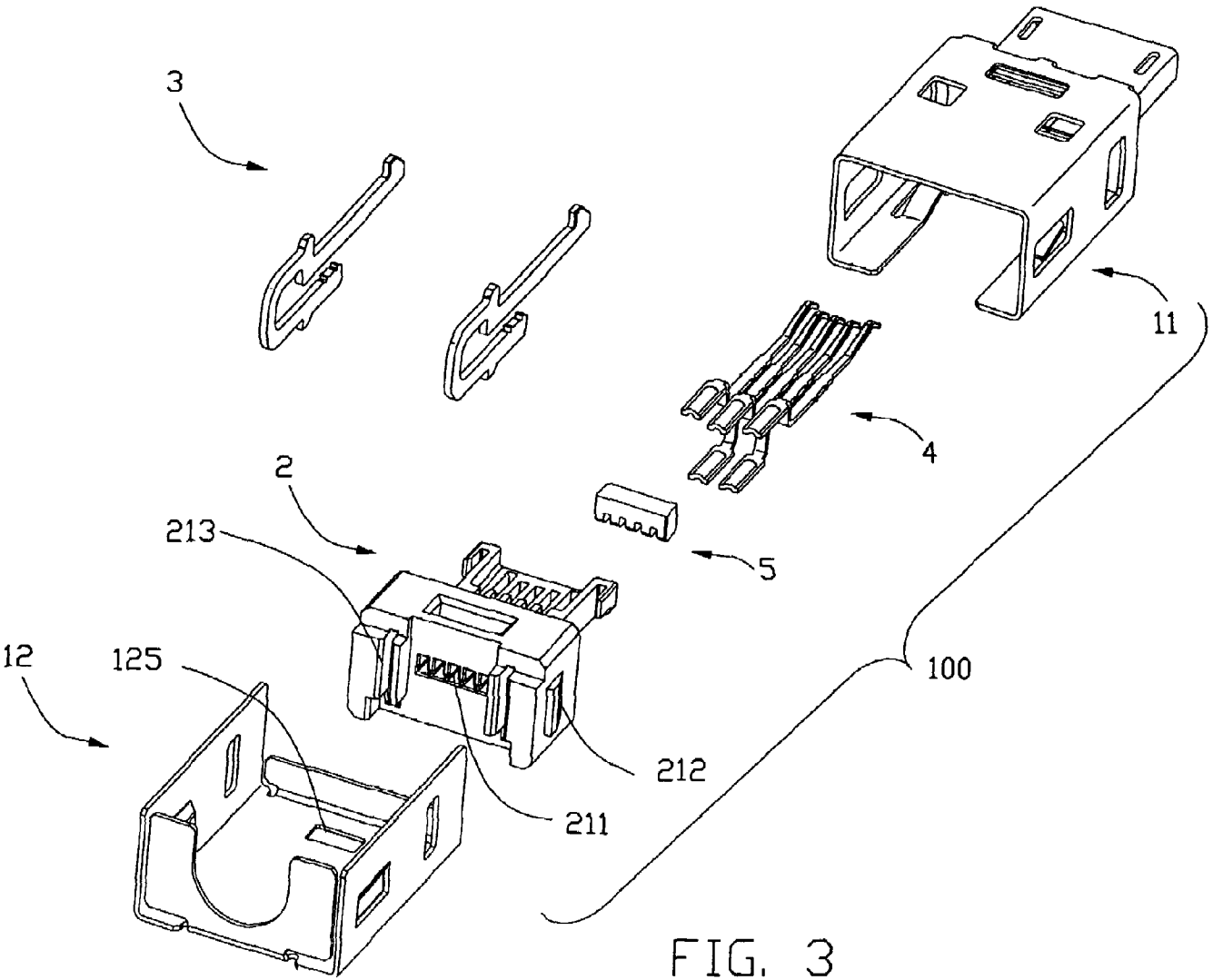
FIG. 3 is a view similar to FIG. 2, but taken from a different aspect.
Figure 4:
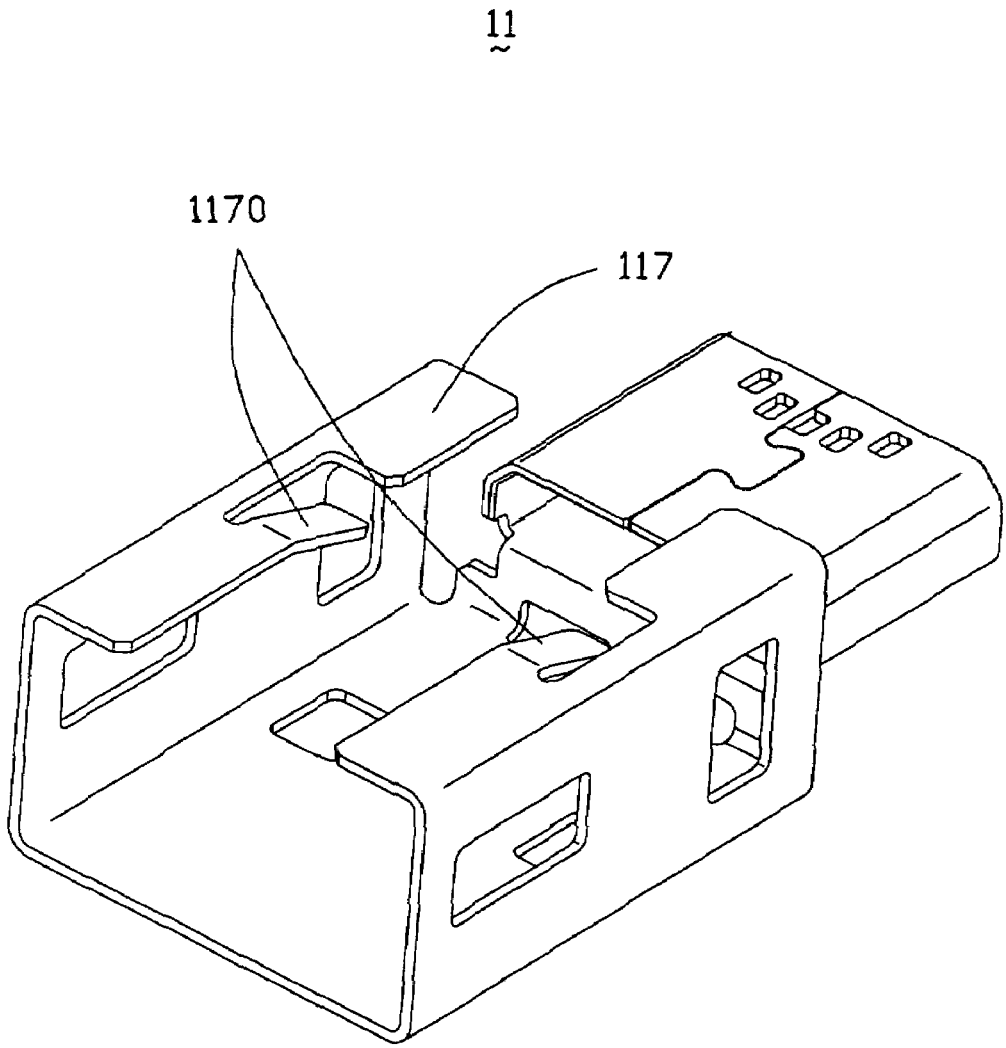
FIG. 4 is a perspective view of a shell of the electrical connector.
Figure 5:
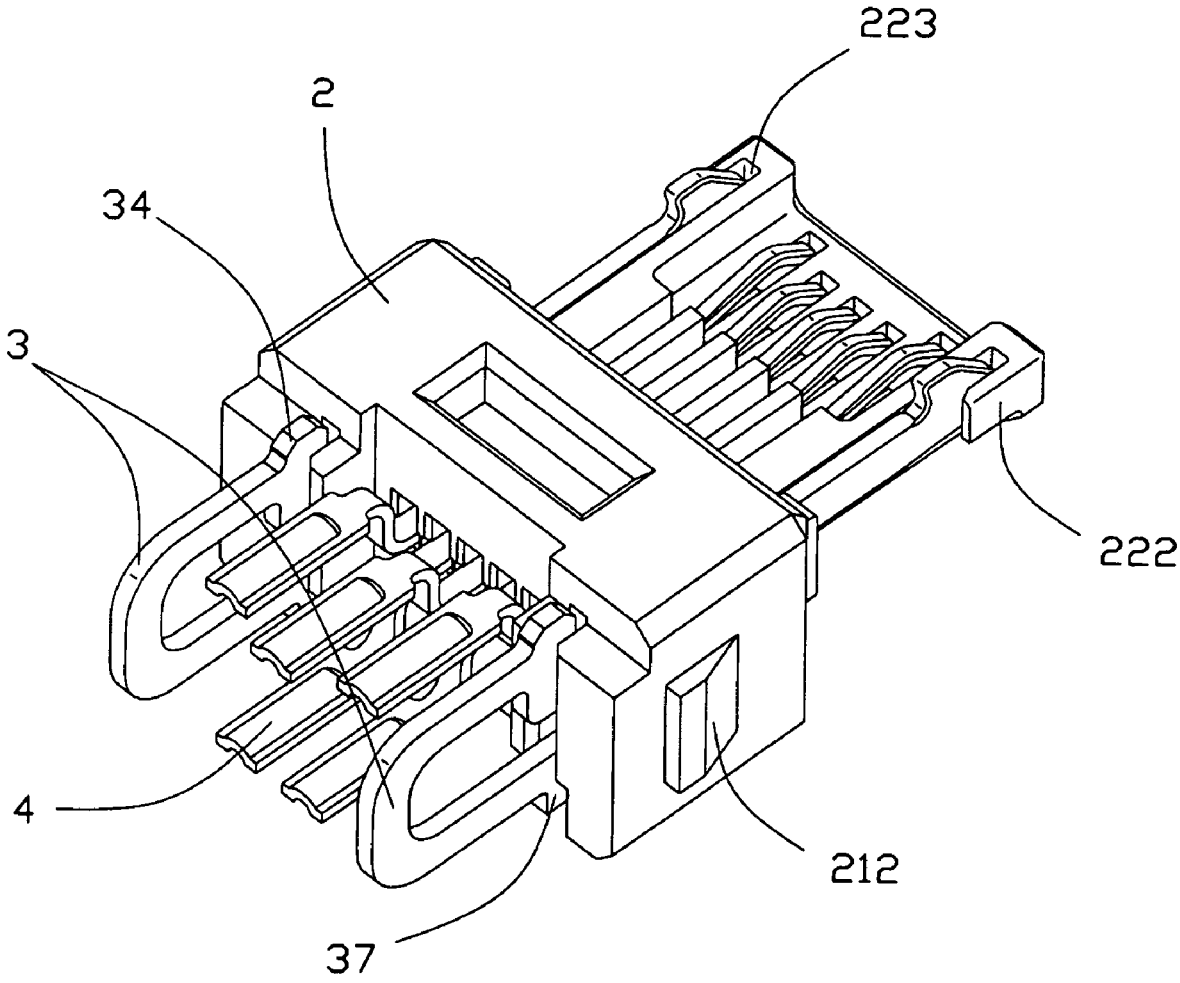
FIG. 5 is a partially assembled, perspective view of the electrical connector.
Figure 6:
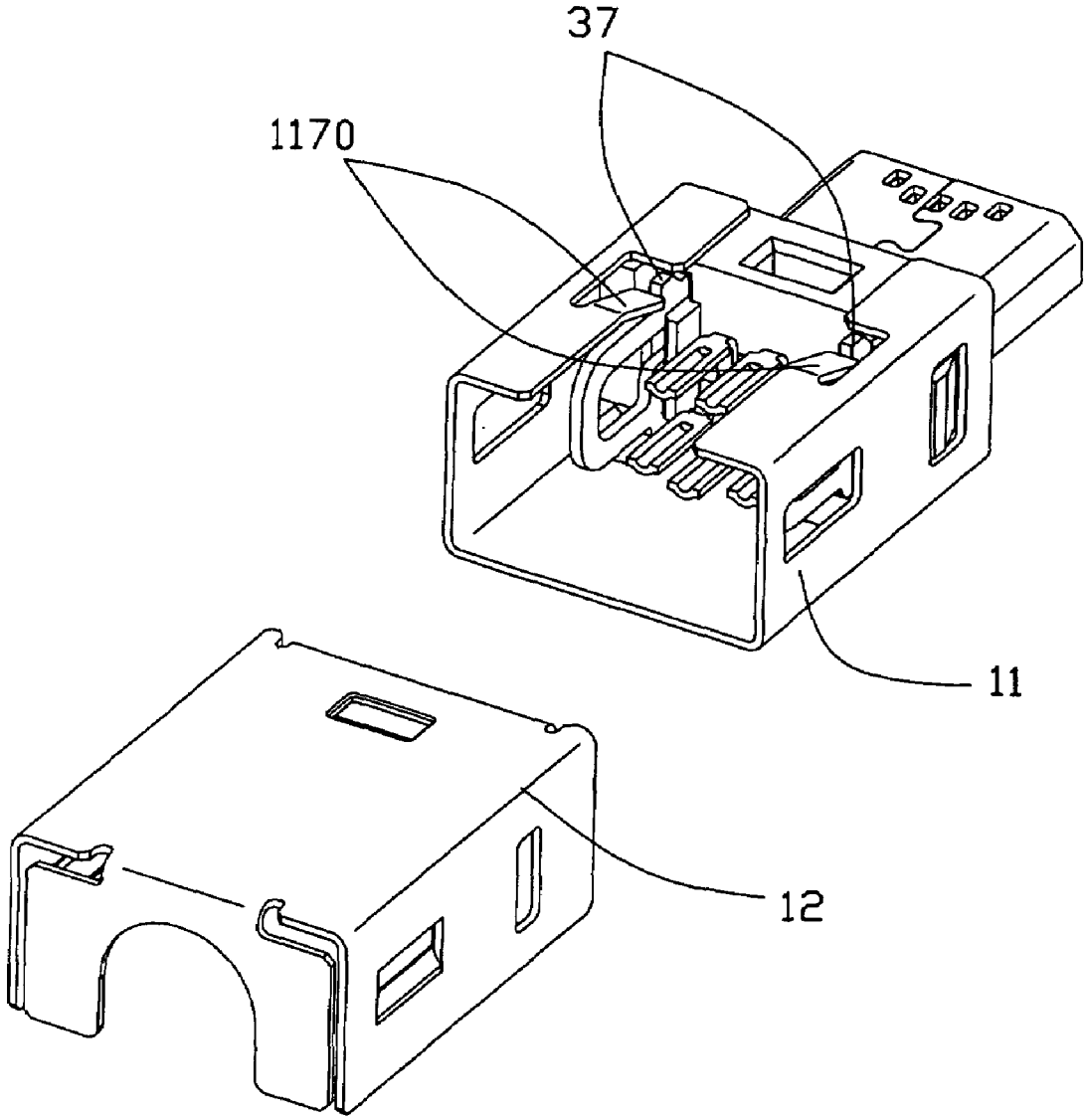
FIG. 6 is another partially assembled, perspective view of the electrical connector.
Figure 7:
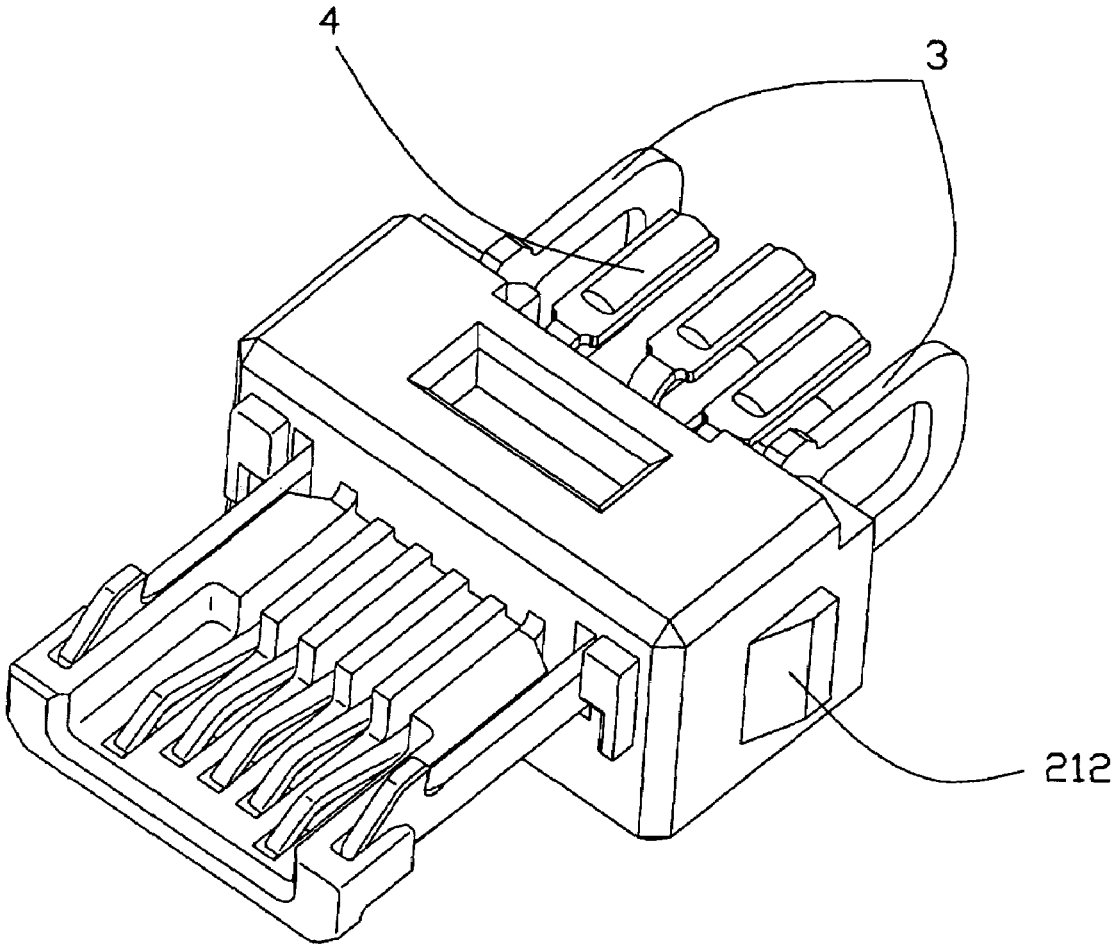
FIG. 7 is a view similar to FIG. 5, but taken from a different aspect.

Particularly referring to FIGS. 1 to 3, the metal shell 1 comprises a top shell 11 and a bottom shell 12. The top shell 11 comprises a main body 111, a connecting tab 115 and a mating portion 112. The main body 111 comprises a top surface 113, a pair of lateral surfaces 114 and a bottom surface 117 (shown in FIG. 4). The top surface 113 comprises a pair of first gaps 1130 and a second gap 1131 located more adjacent to the connecting tab 115 than that of first gaps 1130. Each lateral surface 114 defines a first cutout 1140 and a second cutout 1141. The bottom surface 117 has a jag (not labeled) thereon and a pair of resilient tabs 1170 bent inwardly from the opposite edges of the jag of the bottom surface 117. The connecting tab 115 is bent downwardly from the main body 111 along an up-to-down direction. The mating portion 12 extends forwardly from the connecting tab 115 along a front-to-back direction. Thereby, the mating portion 112 can move along the up-to-down direction relative to the main body 111 through the connecting tab 115. Certainly, the connecting tab 115 also can extend from the lateral surface 114, accordingly, the mating portion 112 move along a lateral direction relative to the main body 111. A pair of rectangular cutouts 116 are defined at a portion where the connecting tab 115 and the main body 111 join. The rectangular cutouts 116 are applied for decreasing the intension of the connecting tab 115, therefore, the connecting tab 115 can be bent more easily. The mating portion 112 defines a mating cavity 118, a pair of positioning tabs 1181 extending backwardly from rear edge thereof, and a pair of receiving cutouts 1180 at a surface of the mating cavity 118.

The bottom shell 12 comprises a bottom wall 121, a front wall 123, a rear wall 122 and a pair of lateral walls 124. These walls together define a receiving cavity (not labeled). The rear wall 122 of the bottom shell 12 has a receiving hole 1220 for cable (not shown) passing through. Each lateral wall 124 forms a block 1240 corresponding to the first cutout 1140 of the top shell 11 and a third cutout 1241 overlapped the second cutout 1141 of the top shell 11. The bottom wall 121 also defines a third gap 125 corresponding to the second gap 1131 of the top shell 11.

Each contact 4 comprises a contacting portion 43, a tail portion 41 and a retaining portion 42 connecting the contacting portion 43 and the tail portion 42. Each tail portion 41 is bent from the retaining portion 42 downwardly/upwardly along the up-to-down direction. So, the space between adjacent tail portions 41 becomes bigger, and it facilitates to soldering the cable to the tail portions 41.

Each locking member 3 comprises a locking arm 31, a resilient arm 33 parallel with the locking arm 31 and a U-shape retaining arm 32. The locking arm 31 and the resilient arm 33 extend from the U-shape retaining arm 32 in a same direction. The locking arm 31 forms a bar 35 at the distal end thereof. The bar 35 forms an incline guiding face 36 thereon. The retaining arm 32 and the locking arm 31, respectively, forms a stopping projection 34, 37 for stopping the locking member 3 has a further movement into the housing 2.

The insulative housing 2 comprises a base portion 21 and a tongue portion 22 extending forwardly from the base portion 21 along the front-to-back direction. The base portion 21 comprises a plurality of receiving passageways 211 therein, and a pair of receiving slits 213 at the opposite ends of the receiving passageways 211. A pair of positioning blocks 214 is, respectively, beside corresponding receiving slits 213. Each positioning block 214 comprises a receiving portion 216 for fixing the connecting tab 112 of the top shell 11. The base portion 21 defines an upper engaging hole 215 and a lower engaging hole (not shown), respectively, defining at the top face and the bottom face thereof. The upper engaging hole 215 communicates with the receiving passageways 211, the lower engaging hole is separated with the receiving passageways 211. The tongue portion 22 defines a plurality of receiving slots 221 communicating with corresponding receiving passageways 211. A pair of the projecting portions 222 are defined at the opposite ends at the tongue portion 22 and form a pair of holding slits 223 with the tongue portion 22. The holding slits 223 are used to receiving the distal ends of the locking members 3, and restrict the movement of the locking member 3 in the lateral direction. The base portion 21 further forms a pair of retaining projections 212 at the opposite lateral faces.

The stopping block 5 receiving in the upper engaging hole 215 comprises a stopping section 51 and an engaging section 52.

During assembly, the contacts 4 are inserted into the housing 2 along the front-to-back direction. The retaining portion 42 of each contact 4 is received in corresponding receiving passageways 211, the contacting portion 43 extends into corresponding receiving slot 221 with tip end exposed outside, and the tail portion 41 is exposed beyond the housing 2. The stopping block 5 is inserted into the housing 2 through the upper engaging hole 215 along the up-to-down direction. The engaging section 52 of the stopping block 5 engages with the retaining portions 42 of the contacts 4, and the stopping section 51 engages with the inner face of the upper engaging hole 215. The upper face of the stopping block 5 is lower than the upper face of the base portion 21 of the housing 2. The locking members 3 are inserted into the receiving slits 213 with the distal end extending into the holding slits 223 and the stopping projections 34, 37 engaging with the rear face of the housing 2. The resilient arms 33 are exposed out of the housing 2.

During the housing 2 is inserted into the top shell 11, the resilient tabs 1170 are bent downwardly because of the pressure on the housing 2. When the base portion 21 of the housing 2 is completely received in the main body 111 of the top shell 11, the resilient tabs 1170 come back to original position for stopping the locking member 3 to untie from the housing 2 in the front-to-back direction. The retaining projections 212 are received in corresponding second cutouts 1141. The tongue portion 22 is received in the mating cavity 118 of the mating portion 112 of the top shell 11. The positioning tabs 1181 are received in the receiving portions 216 of the positioning blocks 214. The positioning blocks 214 engage with the connecting tabs 115 in the up-to-down direction, and engage with rear edge of the mating portion 112 in the front-to-back direction. The positioning block 214 restricts the mating portion 112 and indicates weather the tongue portion 22 of housing 2 is completely received in the mating cavity 118. The stopping projection 34 of each locking member 3 is in a line with corresponding first gap 1130, and the bar 35 of each locking member 3 passes through corresponding receiving cutouts 1180 of the mating portion 112. The bottom shell 12 is assembled to the housing 2 and the top shell 11 from down to up. The blocks 1240 of the lateral wall 124 of the bottom shell 12 are received in the first cutouts 1140 of the top shell 11, the third cutouts 1241 hold the retaining projection 212 of the housing 2.

Because the mating portion 112 of the top shell 11 just connects with one edge of the main body 111 of the top shell 11, it is easily to bend the mating portion 112 relative to the main body 111. During the electrical connector 100 is inserted into the complementary connector, if the force working on the electrical connector is overage, the mating portion 112 is easily broken. Thereby, it avoids the complementary connector to be broken.

It is to be understood, however, that even though numerous characteristics and advantages of the present invention have been set forth in the forgoing description, together with details of the structure and function of the invention, the disclosure is illustrative only, and changes may be made in detail, especially in matters of shape, size, and arrangement of parts within the principles of the invention to the full extent indicated by the broad general meaning of the terms which the appended claims are expressed.

We claim:

1. An electrical connector adapted for connecting/disconnecting with/from a complementary connector in a front-to-back direction, comprising:

a shell comprising a main body, a connecting tab and a mating portion, the main body further comprising a receiving space surrounded by a top surface, a bottom surfaces, and a pair of lateral surfaces, said connecting tab only connecting with one edge of said surface of the main body, said mating portion extending from the connecting tab in the front-to-back direction;

an insulative housing comprising a base portion received in the receiving space of the main body of the shell, and a tongue portion extending from the base portion along the mating direction and received in the mating portion of the shell; and a plurality of contacts receiving in the housing;

wherein a cutout is defined at a portion where the main body and the connecting portion join; the connector further comprising a locking member constructed for locking with the complementary connector; wherein the locking member comprises a locking arm, a retaining arm and a U-shape resilient arm connecting the locking arm and the retaining arm, and wherein the locking arm forms a bar at the distal end thereof for locking with the complementary connector; wherein the tongue portion forms a pair of projecting portions at opposite ends thereof, each projecting portion defines a holding slit with the tongue portion, wherein the bars of locking member is received in corresponding holding slit of the housing; and wherein the retaining arm and the locking arm forms a stopping projection extending downwardly.

2. The electrical connector as described in claim 1, wherein a top shell comprises a pair of receiving cutouts at the mating portion, and wherein the bar of each locking member passes through and is exposed out of the top shell.

3. The electrical connector as described in claim 1, wherein the shell forms a pair of resilient tabs bent inwardly from the bottom surface thereof, and wherein the resilient tab resists with the stopping projection for stopping locking member has a further movement into the housing along the front-to-back direction.

4. The electrical connector as described in claim 1, wherein the shell comprises a top shell and a bottom shell, the connecting tab extends downwardly from front edge of a top surface of the top shell.

5. The electrical connector as described in claim 2, wherein the top shell comprises said main body and said mating portion.

6. The electrical connector as described in 1, wherein the housing forms a positioning block, and the shell forms a positioning tab corresponding to positioning block.

7. The electrical connector as described in claim 6, wherein the positioning block comprises a receiving portion for receiving the positioning tab of the shell.

8. The electrical connector as described in claim 1, further comprising a stopping block, and wherein the stopping block comprises a stopping section and an engaging section inserted into the housing.

9. The electrical connector as described in claim 4, wherein the housing comprises an upper engaging hole receiving the stopping block for engaging with the contacts in the housing.

10. An electrical connector comprising:

an insulative housing including a main body with a mating tongue extending forwardly therefrom;

a plurality of passageways extending in a front-to-back direction in the housing;

a plurality of contacts disposed in the corresponding passageways, respectively, each of said contacts defining a resilient contacting section exposed above the mating tongue;

a pair of locking members respectively positioned on two sides of the housing, each of said locking members including a locking bar at a distal end region;

a metallic shell including a rear section covering the body and a front section covering the mating tongue; wherein the front section cooperates with the mating tongue to define a mating space for receiving another mating plate of a complementary connector, and the contacting sections and the locking bars extend toward the mating space away from the mating tongue in a same direction;

the mating tongue defines two opposite side walls located by two sides of the mating space, and the pair of locking members are disposed in said two side walls;

the front section essentially fully encloses the mating tongue not only circumferentially but also along the front-to-back direction, and wherein the mating tongue defines a shoulder thereon so as to define a rear end of the mating space, and said shoulder is essentially located around a middle area of the mating tongue along the front-to-back direction.

11. The electrical connector as claimed in claim 10, wherein the front section defines a plane facing the mating space and equipped with a pair of through holes through which the locking bars extend.

12. An electrical connector comprising:

an insulative housing including a main body with a mating tongue extending forwardly therefrom;

a plurality of passageways extending in a front-to-back direction in the housing;

a plurality of contacts disposed in the corresponding passageways, respectively, each of said contacts defining a contacting section exposed on the mating tongue;

a pair of locking members respectively positioned on two sides of the housing, each of said locking members including a locking bar at a distal end region;

a metallic shell including a rear section covering the body and a front section covering the mating tongue;

the front section cooperating with the mating tongue to define a mating space for receiving another mating plate of a complementary connector, and the mating tongue defining two opposite side walls located by two sides of the mating space, and the pair of locking members are disposed in said two side walls;

the mating tongue defining a U-shaped cross-sectional configuration in a front portion thereof, and said U-shaped cross-sectional configuration cooperating with a plate of the front section of the shell to form said mating space; wherein said plate directly faces said contacting section; wherein the contacting sections and the locking bars extend toward the mating space away from the mating tongue in a same direction.

* * * * *